US006476721B1

(12) United States Patent
Diebold

(10) Patent No.: US 6,476,721 B1
(45) Date of Patent: Nov. 5, 2002

(54) ALARM ARRANGEMENT

(75) Inventor: Bernhard Diebold, Diep River (ZA)

(73) Assignee: Diel Marketing (Pty) Ltd., Diep River (ZA)

( * ) Notice: Subject to any disclaimer, the term of this patent is extended or adjusted under 35 U.S.C. 154(b) by 0 days.

(21) Appl. No.: 09/806,996

(22) PCT Filed: Oct. 5, 1999

(86) PCT No.: PCT/IB99/01631

§ 371 (c)(1),
(2), (4) Date: Apr. 6, 2001

(87) PCT Pub. No.: WO00/21050

PCT Pub. Date: Apr. 13, 2000

(30) Foreign Application Priority Data

Oct. 7, 1998 (ZA) ..... 98/9131

(51) Int. Cl.[7] ..... G08B 23/00

(52) U.S. Cl. ..... 340/573.6; 340/566; 367/131; 367/141

(58) Field of Search ..... 340/573.6, 573.2, 340/573.1, 539, 566; 367/131, 141, 178

(56) References Cited

U.S. PATENT DOCUMENTS 3,810,146 A * 5/1974 Lieb ..... 340/541
4,408,193 A * 10/1983 Millen ..... 340/566
4,510,487 A * 4/1985 Wolfe et al. ..... 340/566
4,644,328 A * 2/1987 Szymansky et al. ..... 340/539
5,059,952 A * 10/1991 Wen ..... 340/573
5,144,285 A * 9/1992 Gore ..... 340/573
5,907,281 A * 5/1999 Miller, Jr. et al. ..... 340/573.6
5,917,413 A * 6/1999 Malin ..... 340/573.1

* cited by examiner

*Primary Examiner*—John Tweel
(74) *Attorney, Agent, or Firm*—Larson & Taylor, PLC

(57) ABSTRACT

An alarm arrangement for swimming pools includes an electronic transmitter unit (16) and an electronic receiver unit (18). The transmitter unit (16) has a housing (20) containing electronic circuitry. Water activated electrical contacts (24, 26) are provided outside the housing (20) for causing energization of the electronic circuitry when coming into contact with water for emitting an ultrasonic operative signal when a person wearing the transmitter unit (16) enters into water in a pool. The receiver unit (18) has a housing (36) containing electronic circuitry, water activated electrical contact (54, 56) outside its housing (36) for causing energization of the electronic circuitry when coming into contact with water, for detecting any preselected operative signal from the transmitter unit (16) when the transmitter unit (16) comes into contact with water in a pool so as to emit a suitable alarm signal.

13 Claims, 4 Drawing Sheets

ALARM ARRANGEMENT

This Application is a 371 of PCT/IB99/01631 filed Oct. 5, 1999.

FIELD OF INVENTION

The present invention relates to alarm arrangements, in particular for use in association with swimming pools.

BACKGROUND TO INVENTION

Children, in particular infants, often fall into swimming pools with fatal consequences. This happens even when parents or other supervisors practically stand next to such children.

Various devices and arrangements have been suggested to avoid such senseless drowning of children. However, these systems often are complicated, very expensive, and some are not effective and suffer from other disadvantages.

U.S. Pat. No. 4,121,200 (Colmenero) discloses a swimming pool alarm system for activating an alarm indicator responsive to the presence of a person in a pool being monitored. The system includes a frequency selective detector responsive to water disturbance created by a person in a swimming pool. The detector enables a transmitter at poolside. A receiver remotely mounted with respect to the poolside transmitter responds to the transmissions therefrom activating the alarm indicator.

In U.S. Pat. No. 4,701,751 (Sackeft) there is disclosed an alarm system for a swimming pool which comprises the use of a height sensing apparatus employing fibre optics and a logic circuit whereby an interruption of a pair of different elevations of light paths is accepted and the alarm remains silent and the interruption of the lowest light path only is reflected sounding an alarm.

U.S. Pat. No. 5,049,859 (Arnell) describes a pool safety alarm system which includes a water-activated sonar transmitter adapted to be worn on the body of a non-swimmer for continuously transmitting low frequency audio signals upon immersion of the transmitter. An underwater microphone or hydrophone is located within the pool and is connected to a receiver circuit having a band pass filter connected to a monostable multivibrator for supplying signals to an alarm.

In U.S. Pat. No. 5,097,254 (Merrithew) there is described a swimmer protection and pool safety warning device comprising a portable sonic signal generating member worn by a swimmer in a pool, the signal generating member having a switch or similar device which is activated at a predetermined depth.

U.S. Pat. No. 5,144,285 (Gore) discloses a pulsed ultrasonic apparatus for monitoring a swimming pool and which includes a transmitter housing securable to a child and provides a swept frequency pulsed output from a transducer within the housing when an electrical circuit is completed by having a pair of tabs on the outside of the housing immersed in water. The output from the transducer is detected by a receiving hydrophone and the hydrophone is connected to receiver circuitry which provides an appropriate alarm signal.

In U.S. Pat. No. 5,274,607 (Bean) there is described a system for continuous echo analysis of a body of liquid, surrounded by walls of known dimension, for the presence of an object.

U.S. Pat. No. 5,369,623 (Zerangue) describes at least one transducer support immersed in a swimming pool. The transducer support has a plurality of transducer means mounted on the support which are capable of sending and receiving acoustic energy.

U.S. Pat. No. 5,486,814 (Quinones) discloses a swimming pool monitoring device which can be attached to a child to constantly transmit an electromagnetic radio wave of a desired frequency. The monitoring device contains a water submersion sensor, which will deactivate the transmitter upon submersion. Whenever transmissions from the monitoring device are interrupted, due to immersion or battery failure, a receiver will sense this condition and activate an alarm, which may be visual, audible, or a signal that is relayed to further remote wireless equipment such as a pager or telephone dialing equipment that is used to dial an emergency telephone number.

In U.S. Pat. No. 5,638,048 (Curry) a sonar, lidar, or radar system is disclosed which generates an alarm signal if a child enters a swimming pool when the system is enabled, and includes multiple safeguards against sounding false alarms due to wind-activated waves in the pool or self interference arising from multi-path propagation of sonar signals. An acoustic or electromagnetic receiver having a narrow bandwidth is employed to demodulate a composite signal spectrum produced by a target object such as a child and signals generated by wind-activated waves.

It is an object of the invention to suggest an alarm arrangement, which is relatively simple and economic, and which is capable of protecting children and other users against the dangers of falling into water.

SUMMARY OF INVENTION

According to the invention, an alarm arrangement for causing an alarm signal to be emitted in response to a person being monitored when entering a water zone, the arrangement including at least one transportable electronic transmitter unit and at least one electronic receiver unit, the arrangement being characterized thereby that the transportable electronic transmitter unit has attachment means for associating it with a user's body, and a housing containing operatively connected electronic circuitry components, and having water activated electrical contacts outside the housing for causing energization of the electronic circuitry when coming into contact with water so as to emit a continuous operative ultra-sonic signal when such a person wearing the transmitter unit enters into water in a water zone being monitored; and the receiver unit having a housing containing operatively connected electronic circuitry components, and having water activated electrical contacts outside the housing for causing energization of the electronic circuitry when coming into contact with water, and being adapted to detect any operative signal at a preselected frequency from the transmitter unit when the transmitter unit comes into contact with water in the water zone being monitored, and the receiver unit being adapted thereupon to emit a suitable alarm signal.

The transmitter unit may include an electronic circuit including operatively connected together connection means for connection to a battery, an electronic switch, a crystal stabilised oscillator, an amplifier and a speaker.

The speaker may be a piezo element.

The transmitter unit may be adapted to emit an operative ultra-sonic signal at a frequency of about 32 kHz.

The receiving unit may include an electronic circuit including operatively connected together connection means for connection to a battery, an electronic switch, a voltage regulator, a voltage comparator, a micro-processor, an active band pass filter, two amplifiers, a phase lock loop, a microphone and a speaker.

The micro-processor may be adapted by a first step to conduct an initial battery check routine whereby the logic state of the voltage comparator is monitored so as to establish whether or not the battery is sufficiently charged and to cause an appropriate signal to be emitted by the speaker.

The micro-processor may be adapted as a second step to monitor the logic state of the electronic switch to establish whether or not the switch is closed.

The electronic switch of the receiver unit may be adapted to close when the electrical contacts located outside of the housing are bridged by way of water, and if not bridged by way of water in a predetermined period of time, to cause an appropriate signal to be emitted by the speaker.

The micro-processor as a third step may be adapted to monitor signals received by the microphone and on reception of an operative signal having a preselected frequency to generate an appropriate signal which is amplified by the amplifier and conveyed to the speaker for emitting an alarm signal.

The micro-processor may be adapted to calculate frequencies of all signals received and on reception of a pre-selected frequency to enter into the first monitoring mode whereby an appropriate signal is emitted by the speaker indicating a sufficiently charged battery and thereafter generating an appropriate signal which is amplified by the amplifier and conveyed to the speaker, which generates an audible alarm signal.

The housing of the transmitter unit may include a base, opposite side walls and a top; the housing defining a first chamber adapted to contain the electronic circuitry components, and further defining a second chamber adapted to removably locate the battery and being closable by way of a threaded nut forming one of the electrical contacts of the transmitter unit.

The housing of the receiver unit may include a hollow cylindrical body closed at one side by a base and closed at the other side by a lid, which is removably and sealingly attached to the cylindrical body by a threaded ring.

The housing may trap a volume of air once the lid is attached, the air rendering the housing to be floatable if placed in water in the water zone.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 1:
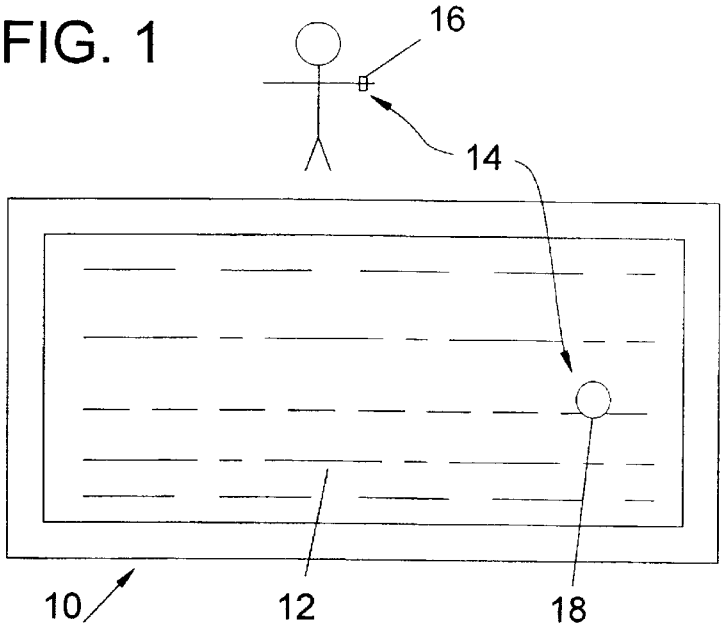
FIG. 1: a general layout of an alarm arrangement in accordance with the invention.

In FIG. 1 a swimming pool 10 is indicated in which water 12 is contained. (It must be noted that the swimming pool 10 may be any water containing zone).

An alarm arrangement in accordance with the invention, generally indicated by reference numeral 14, includes a transmitter unit 16, such as a waist belt, arm bracelet or ankle bracelet adapted to be worn by a person such as a child, and at least one receiver unit 18 located strategically in or around the swimming pool 10. In the drawing the receiver unit 18 is shown to be located floatingly inside the water 12 of the swimming pool 10.

Figure 2:
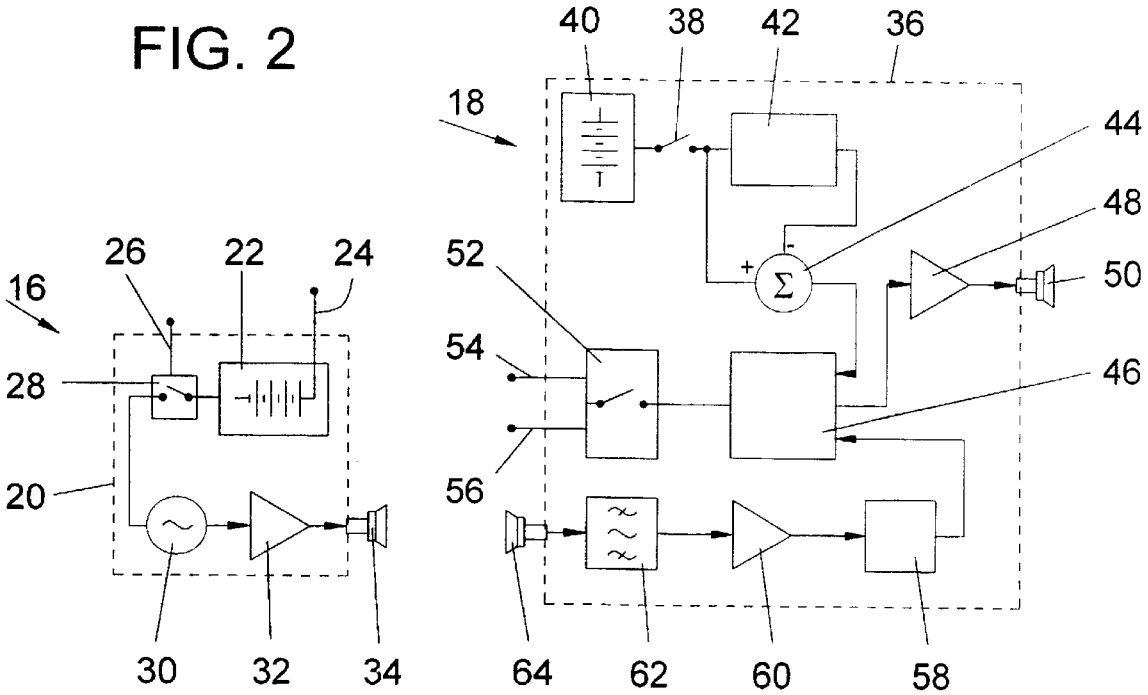
FIG. 2: a block diagram of the electronic components of the alarm arrangement as shown in FIG. 1.

Referring to FIG. 2, a block diagram of the various components is illustrated.

The transmitter unit 16 is encased in a water tight housing 20, in which there is provided a battery 22 and two contacts 24, 26, which are exposed on the outside of the housing 20. The contact 24 is connected to the positive side of the battery 22. Further there are connected in series to the battery 22, an electronic switch 28, a crystal stabilized oscillator 30, an amplifier 32 and a speaker 34, such as a piezo element. The various electronic components and the interconnection thereof are shown in detail in FIG. 3.

When the transmitter unit 16 is outside the water 12 of the swimming pool 10, an electrical resistance created by the ambient air exists between the contacts 24, 26. This electrical resistance is extremely large. On the other hand, when a user wearing the transmitter unit 16 falls into the swimming pool 10, the transmitter unit 16 is submerged in the water 12. Thereby water is present between the contacts 24, 26 and the electrical resistance between these contacts is reduced. This lower resistance causes current to flow so as to activate the electronic switch 28, which allows the battery 22 to energise the oscillator 30 and the amplifier 32. The output of the amplifier 32 causes the piezo element 34 to vibrate at a certain crystal frequency, and a signal is created in the water 12 of the swimming pool 10.

The signal emitted by the piezo element 34 is an ultrasonic signal.

Figure 4:
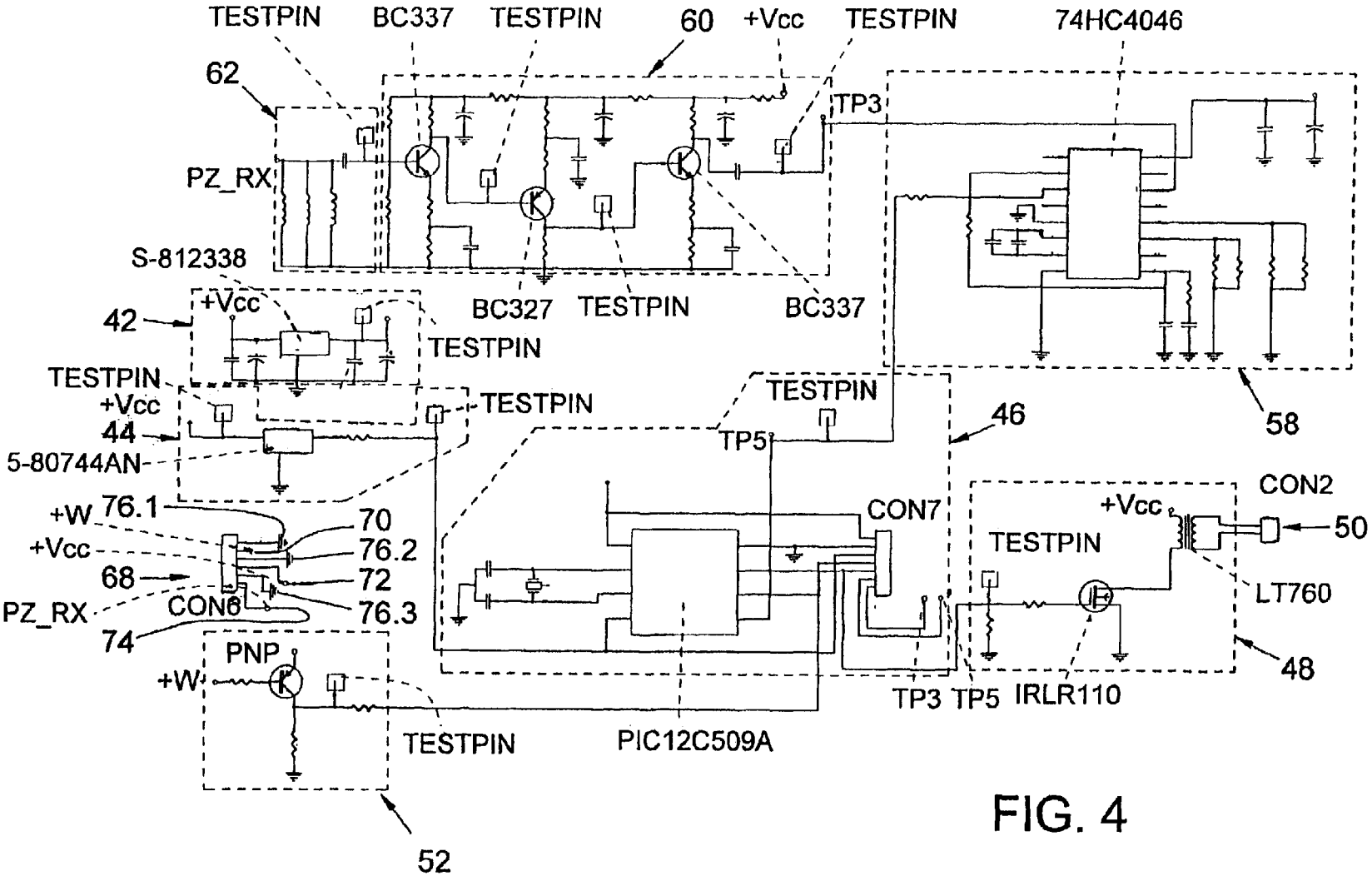
FIG. 4: a circuit diagram of the receiver unit of the alarm arrangement referred to in FIG. 2.

Reference now will be made to the receiver unit 18, of which the electronic circuit diagram is shown in FIG. 4. The receiver unit 18 is encased in a water tight housing 36 and floats in the swimming pool 10.

By opening the housing 36, a slide switch 38 can be accessed in order to activate the receiver unit 18. This allows power to be supplied from a battery 40 to other internal circuitry of the receiver unit 18. However, the slide switch 38 also can be omitted so that when a battery or batteries are connected, then the receiver unit 18 is energized.

The internal circuitry of the receiver unit 18 includes a voltage regulator 42, which is connected to the battery 40 and a voltage comparator 44. The voltage comparator 44 is further connected to a microprocessor 46.

After activation, the microprocessor 46 enters an initial battery check routine or first monitoring mode whereby it monitors the logic state of the voltage comparator 44. If the voltage of the battery 40 is above a reference voltage, the microprocessor 46 generates a signal which is amplified by an amplifier 48 and conveyed to a speaker 50 which generates an audible tone indicating to a user that the battery 40 is still good. Alternatively a light (e.g. an LED diode) may be included in the circuitry and may be mounted visibly on the housing 36 to indicate that a battery of sufficient strength is included in the circuitry. Thus a person can observe at a distance from the receiver unit 18 whether or not the unit 18 is in operative condition.

After this first monitoring mode, the microprocessor 46 has a thirty second time delay, allowing the user first to close the housing 36 and then to place the receiver unit 18 in the water 12.

On expiration of the thirty second time delay, the microprocessor 46 enters a second monitoring mode where it monitors the logic state of an electronic switch 52, which is connected to two contacts 54, 56 that extend beyond and are exposed outside the housing 36. If the contacts 54, 56 are submerged in water, the electrical resistance between them is relatively low, causing the electronic switch 52 to close.

The microprocessor 46 is further connected in series to a phase lock loop 58, an amplifier 60, an active band pass filter 62 and a microphone 64. The microphone 64 is located in the housing 36 such that it can detect any signals which may exist in the water 12.

Once the switch 52 has closed, the microprocessor 46 enters a third monitoring mode whereby it monitors all signals detected by the microphone 64. This is the normal operating condition for the receiver unit 18. No alarm will sound unless an appropriate operative signal is received from the transmitter unit 16.

If the receiver unit 18 is not placed into the water 12 before the expiration of the thirty second time delay, the microprocessor 46 will generate a signal which is amplified by the amplifier 48 and conveyed to the speaker 50, which generates an appropriate audible tone, indicating that the receiver unit 18 is out of the water 12.

When both the transmitter unit 16 and the receiver unit 18 are activated, the signal emitted by speaker 34 in the water 12 is picked up by the microphone 64. The signal is passed through the active band pass filter 62, which limits the received signal bandwidth to improve the signal-tonoise ratio. The output from the filter 62 is amplified by the amplifier 60 and applied to the phase lock loop 58, which will only lock onto signals within a very narrow bandwidth of the frequency of the signal emitted by the transmitter 16. The output of the phase locked loop 58 is monitored by the microprocessor 46, which is programmed as a frequency counter. The microprocessor 46 will calculate the frequency of all the signals it receives and as soon as it receives a correct or preselected frequency, it firstly enters the first monitoring mode whereby it causes the sounding of the appropriate tone by the speaker 50 to indicate whether the battery is still good. Thereafter, the microprocessor 46 generates a signal, which is amplified by the amplifier 48 and conveyed to the speaker 50, which then generates an audible alarm tone. The alarm will sound for as long as an acoustic signal is received by the microphone 64 from the transmitter 16. The alarm signal can be continuous or intermittent.

This means that if a child or other person or even animal wearing a transmitter unit 16 falls into the water 12 of the swimming pool 10, an ultra-sonic signal emitted by the piezo element 34 is picked up by the microphone 64, which results in an alarm signal to be emitted by the speaker 50. Any person around the pool 10 thereby is notified that a wearer of a transmitter 16 is in the water 12 and may be in need of help.

When it is necessary to switch off the receiver unit 18, it is taken out of the water 12. As the contacts 54, 56 are now outside the water 12, the electronic switch 52 opens and the microprocessor 46 enters the first monitoring mode. Thereafter the microprocessor 46 enters a thirty second time delay where after it will generate an alarm tone indicating that the receiver unit 18 is out of the water 12. This thirty second time delay allows the user enough time to open the housing 36 and switch off the switch 38.

If a user wishes to test whether the batteries 22, 40 still supply satisfactory power, the user can do so by using two methods.

According to the first method, if only the battery 40 of the receiver unit 18 is to be tested, the user can simply lift the receiver unit 18 out of the water 12. As explained above, this causes the microprocessor to enter the first monitoring mode, thereby sounding an audible tone if the battery 40 is satisfactory.

According to the second method, if both batteries 22, 40 are to be tested, the user can place the transmitter 16 into the water 12. As explained above, this causes the microprocessor to enter the first monitoring mode, thereby sounding an appropriate audible tone if the battery 40 is satisfactory. The user can then remove the transmitter 16 from the water 12 before the alarm signal is generated. This will automatically also test whether the battery 22 is satisfactory, and if it is not satisfactory, no acoustic signal will be generated in the water 12 and no audible tone will sound.

More than one transmitter 16 can be used at the same time in connection with a single receiver unit 18.

The microphone 64 conveniently is provided at the underside 66 of the housing 36 to ensure that proper water contact is made allowing the microphone 64 to pick up signals emitted by the transmitter 16.

As is shown in FIG. 4, a connector 68 is provided with contacts 70, 72, 74, 76.1, 76.2, 76.3. Contact 70 is coupled to the one exposed water contact 54. Contact 76.1 is coupled to the other exposed water contact 56. Contact 70 is coupled to the positive terminal of the battery or batteries 40. Contact 76.2 is coupled to the negative terminal of the battery or batteries 40. Contact 74 is coupled to the one terminal of the microphone 64. Contact 76.3 is coupled to the other terminal of the microphone 64.

Conveniently the crystal oscillator 30 oscillates at a frequency of 32,768 KHz, which is in the ultrasonic range.

The phase locked loop 58 locks onto any signal within a band width of about 15 kHz central around 32.768 kHz, being the frequency of the transmitter unit 16.

Figure 3:
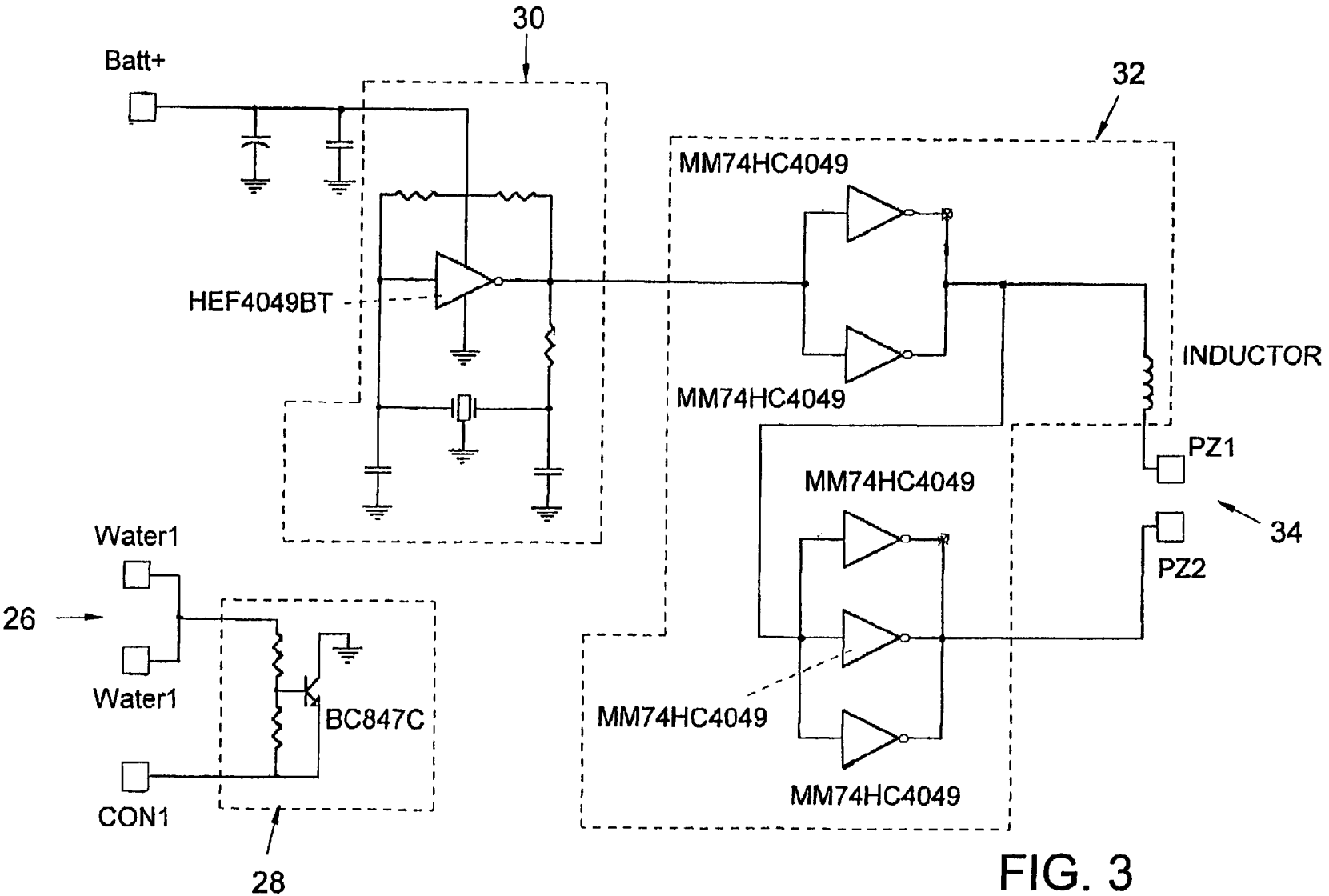
FIG. 3: a circuit diagram of the transmitter unit of the alarm arrangement referred to in FIG. 2.
Figure 5:
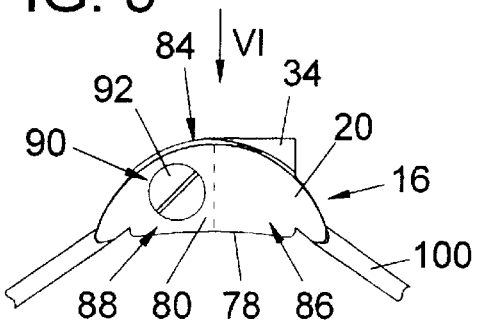
FIG. 5: a side view of a transmitter unit including the circuit diagram illustrated in FIG. 3.
Figure 6:
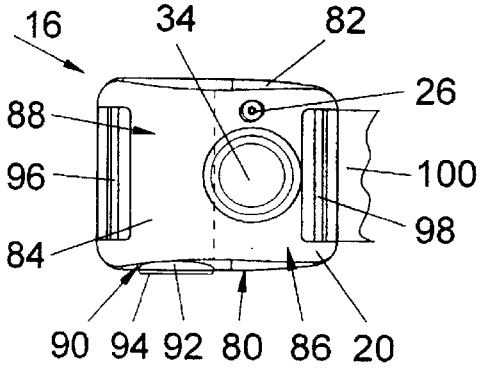
FIG. 6: a plan view seen along arrow VI in FIG. 5.

In FIGS. 5 and 6 details of a transmitter unit 16 and its housing 20 are shown. The housing 20 has a base 78, side walls 80, 82 and a curved top 84, defining two chambers 86, 88. The chamber 86 receives in watertight manner the electronic circuit of the transmitter unit 16 as illustrated in FIG. 3 so that only the contact 26 protrudes to the outside of the housing 20. The chamber 88 has an opening 90 at one end and receives the battery 22. The opening 90 is sealingly closed by way of a nut 92 with a sealing rubber ring 94. The nut 92 constitutes the contact 24.

The housing 20 further has opposite slots 96, 98 in the base 78 receiving a strap 100 for attachment to a user's arm, leg or waist.

Figure 7:
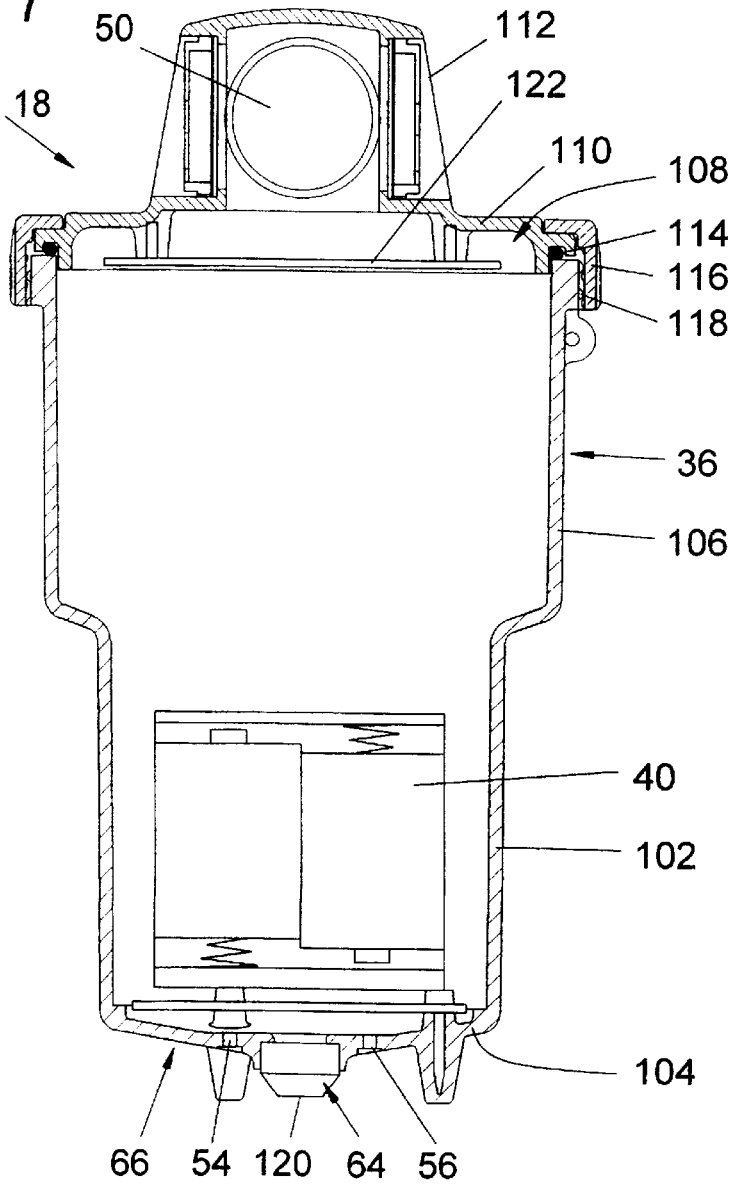
FIG. 7: a sectional front view of a receiver unit including the circuit diagram illustrated in FIG. 3.

In FIG. 7 details of the receiver unit 18 and its housing 36 are shown.

The housing 36 has a bottom cylindrical part 102 with a floor 104, and integrally formed therewith a wider top cylindrical part 106 terminating in an open end 108. The open end 108 is closable by way of a disc 110 carrying a top knob 112 and, on its underside receiving a sealing rubber ring 114 fitting onto the cylinder 106 around the open end 108. The disc 110 is clamped onto the open end 108 by an integrally threaded ring 116 engaging screwingly with an external screw thread 118 at the outer upper end of the cylinder 106. Thereby the housing 36 is sealingly and air tight closed and can float in water.

On the floor 104 the microphone 64 is fitted with its receiving end 120 projecting to the outside to be in good contact with the water. Also the contacts 54, 56 are located on the outside of the floor 104.

The battery (or batteries) 40 are located in the bottom cylinder 102. The remainder of the electronic circuitry is mounted on a plate 122 fitted to the disc 110.

The knob 112 supports the speaker 50.

The receiver unit 18 and its housing 36 float in water so that the bottom cylinder 102 and part of the upper cylinder 106 are submerged in the water.

The alarm arrangement 14 in accordance with the invention therefore provides that easily operable units are used to achieve the intended object. Firstly there is the receiver unit 18 which is energized by a battery 40 and which floats in water, e.g. a swimming pool. Thus no connections to the outside are required. Secondly the transmitter unit 16 is contained in a housing 20 which receives a battery 22 and which is attached by way of a strap 100 to a user's body.

Should the user fall into the water, after a predetermined delay of, say, 5 seconds, an ear piercing alarm is emitted by the receiver unit 18 to draw attention to the fact that a person has fallen into the water and is in need of help. Furthermore, a single receiver unit 18 can control several transmitter units 16 attached to different users.

Insofar as is possible the various components of the housing 20 of the transmitter unit 16 and the housing 36 of the receiver unit 18 are made of plastics material by injection moulding.

10. swimming pool
12. water
14. alarm arrangement
16. transmitter unit
18. receiver unit
20. housing
22. battery
24. contact
26. contact
28. electronic switch
30. oscillator
32. amplifier
34. speaker
36. housing
38. switch
40. battery
42. voltage regulator
44. voltage comparator
46. microprocessor
48. amplifier
50. speaker
52. switch
54. contact
56. contact
58. phaselock loop
60. amplifier
62. active band pass filter
64. microphone
66. underside of cylinder
68. connector
70. contact
72. contact
74. contact
76.1 contacts
76.2 contacts
76.3 contacts
78. base
80. side wall
82. side wall
84. curved top
86. chamber
88. chamber
90. opening
92. nut
94. sealing ring
96. slot
98. slot
100. strap
102. bottom cylindrical part
104. floor
106. top cylindrical part
108. open end
110. disc
12. knob
114. sealing ring
116. threaded ring
118. screw thread
120. receiving end
122. plate

What is claimed is:

1. An alarm arrangement for causing an alarm signal to be emitted in response to a person being monitored when entering a water zone, the arrangement including at least one transportable electronic transmitter unit (16) and at least one electronic receiver unit (18), and being characterized thereby that the transportable electronic transmitter unit (16) has attachment means (100) for associating it with a user's body, and a housing (20) containing operatively connected electronic circuitry components, and having water activated electrical contacts (24, 26) outside the housing (20) for causing energization of the electronic circuitry when coming into contact with water so as to emit a continuous ultrasonic operative signal when such a person wearing the transmitter unit (16) enters into water in a water zone (10) being monitored; and the receiver unit (18) having a housing (36) containing operatively connected electronic circuitry components, and having water activated electrical contacts (54, 56) outside the housing (36) for causing energization of the electronic circuitry when coming into contact with water, and being adapted to detect any operative signal at a preselected frequency from the transmitter unit (16) when the transmitter unit (16) comes into contact with water in the water zone (10) being monitored, and the receiver unit (18) being adapted thereupon to emit a suitable alarm signal.

2. An alarm arrangement as claimed in claim 1, characterized thereby that the transmitter unit (16) includes an electronic circuit including operatively connected together connection means for connection to a battery (22), an electronic switch (28), a crystal stabilised oscillator (30), an amplifier (32) and a speaker (34).

3. An alarm arrangement as claimed in claim 2, characterized thereby that the speaker is a piezo element.

4. An alarm arrangement as claimed in any one of the preceding claims, characterized thereby that the transmitter unit (16) is adapted to emit an operative ultra-sonic signal at a frequency of about 32 kHz.

5. An alarm arrangement as claimed in claim 1, 2, or 3, characterized thereby that the receiving unit (18) includes an electronic circuit including operatively connected together connection means for connection to a battery (40), an electronic switch (52), a voltage regulator (42), a voltage comparator (44), a micro-processor (46), an active band pass filter (62), two amplifiers (48, 60), a phase lock loop (58), a microphone (64) and a speaker (50).

6. An alarm arrangement as claimed in claim 5, characterized thereby that the micro-processor (44) is adapted by a first step to conduct an initial battery check routine whereby the logic state of the voltage comparator (44) is monitored so as to establish whether or not the battery (40) is sufficiently charged and to cause an appropriate signal to be emitted by the speaker (50).

7. An alarm arrangement as claimed in claim 6, characterized thereby that the micro-processor (46) is adapted as a second step to monitor the logic state of the electronic switch (52) to establish whether or not the switch (52) is closed.

8. An alarm arrangement as claimed in claim 7, characterized thereby that the electronic switch (52) of the receiver unit (18) is adapted to close when the electrical contacts (54, 56) located outside of the housing (36) are bridged by way of water, and if not bridged by way of water in a predetermined period of time, to cause an appropriate signal to be emitted by the speaker (50).

9. An alarm arrangement as claimed in claim 8, characterized thereby that the micro-processor (46) as a third step is adapted to monitor signals received by the microphone (64) and on reception of an operative signal having a preselected frequency to generate an appropriate signal which is amplified by the amplifier (46) and conveyed to the speaker (50) for emitting an alarm signal.

10. An alarm arrangement as claimed in claim 9, characterized thereby that the micro-processor (46) is adapted to calculate frequencies of all signals received and on reception of a preselected frequency to enter into the first monitoring mode whereby an appropriate signal is emitted by the speaker (50) indicating a sufficiently charged battery (40) and thereafter generating an appropriate signal which is amplified by the amplifier (46) and conveyed to the speaker (50), which generates an audible alarm signal.

11. An alarm arrangement as claimed in any one of claims 1 to 3, characterized thereby that the housing (20) of the transmitter unit (16) includes a base (78), opposite side walls (80, 82) and a top (84); the housing (20) defining a first chamber (86) adapted to contain the electronic circuitry components, and further defining a second chamber (88) adapted to removably locate the battery (22) and being closable by way of a threaded nut (92) forming one of the electrical contacts (24) of the transmitter unit (16).

12. An alarm arrangement as claimed in claims 1, 2, or 3, characterized thereby that the housing (36) of the receiver unit (18) includes a hollow cylindrical body (102, 106) closed at one side by a base (104) and closed at the other side by a lid (110), which is removably and sealingly attached to the cylindrical body (102, 106) by a threaded ring (116).

13. An alarm arrangement as claimed in claim 12, characterized thereby that the housing (36) traps a volume of air once the lid (110) is attached, the air rendering the housing (36) to be floatable if placed in water in the water zone (10).

* * * * *